US008556308B2

(12) United States Patent
Lavrencic

(10) Patent No.: US 8,556,308 B2
(45) Date of Patent: Oct. 15, 2013

(54) ELECTROMAGNETIC BLOCKING DEVICE FOR THE DOOR OF AN ELECTRIC HOUSEHOLD APPLIANCE, IN PARTICULAR THE DOOR OF A WASHING MACHINE

(75) Inventor: Joze Lavrencic, Kobarid (SI)

(73) Assignee: Itw Metalflex, Druzba za Proizvodnjo Delov za Gospondinjske Aparate, D.O.O., Tolmin (SL)

( * ) Notice: Subject to any disclaimer, the term of this patent is extended or adjusted under 35 U.S.C. 154(b) by 970 days.

(21) Appl. No.: 12/664,999

(22) PCT Filed: Jun. 27, 2008

(86) PCT No.: PCT/IB2008/001691

§ 371 (c)(1),
(2), (4) Date: Dec. 16, 2009

(87) PCT Pub. No.: WO2009/004447

PCT Pub. Date: Jan. 8, 2009

(65) Prior Publication Data

US 2010/0181783 A1 Jul. 22, 2010

(30) Foreign Application Priority Data

Jun. 29, 2007 (IT) ..... TO2007A0476

(51) Int. Cl.
*E05B 15/02* (2006.01)

(52) U.S. Cl.
USPC ..... 292/341.16; 292/341.15; 292/341.17; 292/DIG. 4; 292/DIG. 69

(58) Field of Classification Search
USPC ..... 292/137, 156, 157, 144, 251.5, 340, 292/341.15, 341.16, 341.17, DIG. 4, 292/DIG. 65, DIG. 69; 126/191, 197, 201; 68/12.26; 134/58 DL
See application file for complete search history.

(56) References Cited

U.S. PATENT DOCUMENTS 2,684,741 A * 7/1954 Gregory ..... 192/69.8
3,204,131 A * 8/1965 Wright, Jr. ..... 307/112

(Continued)

FOREIGN PATENT DOCUMENTS

EP 1039012 A1 9/2000

OTHER PUBLICATIONS

ISR and WO for PCT/IB2008/001691 dated Oct. 22, 2008.

*Primary Examiner* — Carlos Lugo
*Assistant Examiner* — Alyson M Merlino
(74) *Attorney, Agent, or Firm* — Lowe, Hauptman & Ham, LLP

(57) ABSTRACT

A blocking device for a door of an electric household appliance in which a plate sliding on a support is selectively blocked in use in a engaging position with a striker of the door by a pawl selectively mobile between an extracted position and a retracted position from/into a sliding seat thereof, in which positions the pawl respectively engages/does not engage a perforation of the plate; wherein the pawl is selectively blocked in an extracted position by means of an electromagnet having a winding and a core mobile along the axis of the winding and operatively associated to a mobile slide parallel to the axis of the winding between a first and a second limit stop position, only in the first of which a protrusion of the slide cooperates with the pawl; a retaining device of push-push type being operatively associated on one side to the slide and on the opposite side to a pre-loaded spring sandwiched between the retaining device and a shoulder fixed in use to the support; the push-push device being configured to block the slide in the first limit stop position following a single energizing pulse of the electromagnet and to release the slide, so as to allow the spring to take it to the second limit stop position, following two consecutive energizing pulses of the electromagnet.

13 Claims, 4 Drawing Sheets

(56) References Cited

U.S. PATENT DOCUMENTS

| | | | | | |
|---|---|---|---|---|---|
| 3,291,101 | A | * | 12/1966 | Helitas | 401/110 |
| 3,617,957 | A | * | 11/1971 | Brighenti | 337/77 |
| 3,892,933 | A | * | 7/1975 | Rocchitelli | 337/77 |
| 4,314,217 | A | | 2/1982 | Krasser | |
| 4,932,707 | A | * | 6/1990 | Ekstran | 292/341.17 |
| 4,988,132 | A | * | 1/1991 | Rocchitelli | 292/144 |
| 5,004,276 | A | * | 4/1991 | Hanley | 292/126 |
| 5,062,668 | A | * | 11/1991 | Onderka et al. | 292/25 |
| 5,072,974 | A | * | 12/1991 | Henne | 292/126 |
| 5,520,424 | A | * | 5/1996 | Hapke et al. | 292/198 |
| 6,036,241 | A | * | 3/2000 | Ostdiek et al. | 292/229 |
| 6,334,637 | B1 | | 1/2002 | Chioffi | |
| 6,840,553 | B2 | * | 1/2005 | Dirnberger et al. | 292/341.16 |
| 7,549,685 | B2 | * | 6/2009 | Mueller et al. | 292/251.5 |
| 8,109,543 | B2 | * | 2/2012 | Chirumbolo | 292/201 |
| 8,186,727 | B2 | * | 5/2012 | Rishel et al. | 292/69 |

* cited by examiner

ELECTROMAGNETIC BLOCKING DEVICE FOR THE DOOR OF AN ELECTRIC HOUSEHOLD APPLIANCE, IN PARTICULAR THE DOOR OF A WASHING MACHINE

RELATED APPLICATIONS

The present application is National Phase of PCT/IB2008/001691 filed Jun. 27, 2008, and claims priority from Italian Application Number TO2007A000476, filed Jun. 29, 2007, the disclosures of which are hereby incorporated by reference herein in their entirety.

TECHNICAL FIELD

The present invention relates to an electromagnetic blocking device for a door of an electric household appliance, in particular for a viewing panel of a front-loading washing machine.

BACKGROUND ART

It is known that the doors of electric household appliances in which a washing cycle is performed, in particular those of front-loading washing machines, are in use blocked in a closed position by a blocking device provided with a safety device which is released only at the end of the washing cycle and, thus, when the electric household appliance is internally free from water.

The known safety devices, e.g. from U.S. Pat. No. 6,334,637, include a blocking pawl and control means for selectively moving the pawl between an extracted position and a retracted position in a through seat of a casing carrying the control means and the pawl itself therein, so that one end of the pawl, which protrudes in the extracted position from the seat may cooperate in use with a plate of the blocking device of the door, slidingly carried by a support on which the casing of the safety device is snappingly fixable; the support is in turn fixable in use to a housing of the electric household appliance, by the side of the door to be blocked and so that the sliding plate is adapted to cooperate in use, in turn, with a striker of the door.

The control devices include, in turn, a first electric actuating device, e.g. a bimetallic foil associated to a thermistor adapted to displace the pawl between the extracted and retracted position, when the electric household appliance is running, and electromagnetic blocking means of the pawl in the extracted position, in which it engages a perforation of the sliding plate, thus blocking the transversal sliding thereof on the support and, consequently, preventing the same from being released from the striker even if the user attempts to force the door into the opening position.

The electromagnetic means include, in turn, an electromagnetic actuator of the linear type which is actuated in use by means of a series of single electric pulses as a consequence of which the core of the electromagnet rotationally actuates, by means of a ratchet, a toothed wheel associated to cam means which selectively block/release the pawl in the extracted position, thus cooperating with a side appendix thereof. In this manner, by means of an appropriate shaping of the cam means and of the toothed wheel associated thereto, it is possible to obtain the blocking of the pawl and, consequently, of the entire blocking device, by applying a single electric pulse to the electromagnetic actuator, while two consecutive electric pulses are needed to release the same.

The known device described above is complex and expensive, as well as cumbersome.

DISCLOSURE OF INVENTION

It is thus the object of the present invention to provide an electromagnetic blocking device for the door of an electric household appliance, in particular for the viewing panel of a front-loading washing machine, which allows to obtain the releasing of the pawl by applying two consecutive pulses and the blocking of the same by means of a single pulse, as in the known art, but which displays, at the same time, a low manufacturing and assembly cost, small dimensions, high reliability and a simple structure.

The claimed device thus relates to a blocking device for a door of an electric household appliance, in particular for a viewing panel of a front-loading washing machine.

In particular, the blocking device of the invention is characterised in that the control means of the pawl comprise an electromagnet having a winding and a mobile core along the axis of the winding, wherein the core is operatively associated to a mobile slide parallelly to the axis of the winding between a first and a second limit stop position, only in the first of which protrusion of the slide cooperates with the pawl to block it in an extracted position, in which the pawl engages a sliding plate by blocking it in the engagement position with a striker of the door.

The control means further comprise a retaining device of the push-push type operatively associated on one side to the slide and on the opposite side to a pre-loaded spring sandwiched between the retaining device and a contrast shoulder fixed in use to the support.

Furthermore, according to the fundamental aspect of the invention, the push-push retaining device is configured so as to be adapted to block the slide in the first limit stop position following a single energising pulse of the electromagnet and to release the slide, so as to allow the spring to take it to the second limit stop position, following two consecutive energising pulses of the electromagnet.

In particular, the push-push retaining device used according to the invention is of the type used in ball-point pens, to control the extraction of the writing tip of the cartridge and comprises an accommodating bushing, integrally secured to the support in use, displaying a through seat defined by a first and a second hole, having different diameter and axis parallel to that of the winding, obtained reciprocally coaxial and in sequence through the bushing from a first side of the same facing the winding in use; a slidingly mounted pin engaged in the second hole of the bushing so that a first end of the pin overhangingly protrudes from the bushing, from the side opposite to the first hole; and a rotor having a first cylindrical end at least in part idly and slidingly engaged, in use, within a hole of the pin, which hole is coaxial to the holes the bushing, and displays an access mouth obtained at a second end of the pin, opposite to the first.

A second end of the rotor, opposite to the first, is further adapted to selectively engage, in use, the first and the second hole of the bushing, axially and abuttingly against the same, in particular against a front toothing of the bushing, obtained between the first and the second hole and against blank ends of axial grooves of the bushing, which extend to interrupt the continuity of the frontal toothing of the bushing, in virtue of a rotation of the rotor obtained by means of the presence of frontal toothings mating those of the bushing, both on the rotor and on the pin, cooperating either selectively or simultaneously in use under the bias of the spring and following the translation motion of the core caused by energising the electromagnet, which produces the attraction of the core against the winding, so as to feed the slide towards the winding, against the bias of the spring, which acts by axially resting on the rotor.

In this manner, by means of an appropriate selection of the number of axial grooves of the bushing and of the teeth of the toothing of the rotor and of the bushing, a control method of the pawl is obtained, which is the same as the control method obtained by the device in U.S. Pat. No. 6,334,637, but by means of a device which is much simpler and more reliable, less expensive and, above all, much smaller, but which is again based on the actuation by means of electromagnet.

BRIEF DESCRIPTION OF THE DRAWINGS

Further features and advantages of the present invention will be apparent from the following description of a non-limitative embodiment thereof, with reference to the accompanying drawings, in which.

BEST MODE FOR CARRYING OUT THE INVENTION

Figure 1:
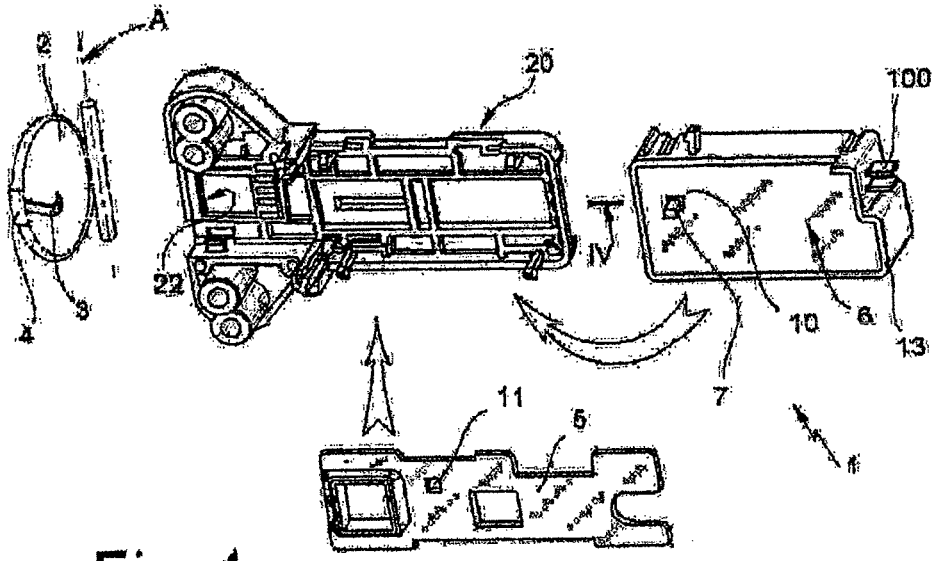
FIG. 1 shows a diagrammatic three-quarters front perspective view, partially from the top, of the blocking device of the invention with parts removed for clarity and shown in a partially exploded view.

With reference to figures from 1 to 9, numeral 1 indicates as a whole a blocking device in a closing position of a door 2 of an electric household appliance, known and not shown for simplicity, e.g. the viewing panel 2 of a front-loading washing machine, rotating about an axis A and provided with a striker 3 which may be actuated by means of a handle 4 (FIG. 1).

The blocking device 1 comprises a striker plate in the form of a preferably metal plate 5 sliding in use perpendicularly to the rotation axis A of the door 2 on a support 20 securable in use close to the door 2, e.g. onto the housing of the electric household appliance. The plate 5 is adapted to cooperate in use, in a per se known manner, with the striker 3 of the door 2; furthermore, the support 20 carries, e.g. snap-mounted thereon in a per se known manner, a safety device, indicated as a whole by numeral 6, comprising in turn a pawl 7 for blocking the sliding of the plate 5 and electrically actuated control means 8 (FIGS. 2-6) of the pawl 7 for selectively moving the pawl 7 between a first position, extracted from, and a second position, retracted in, a through seat 10 obtained through a casing of the safety device 6, in which extracted and retracted positions the pawl 7 is, respectively, adapted to engage/not engage the through perforation 11 of the plate 5 to block/not block the latter, in use, engaged with the striker 3.

In particular, the casing 13 is secured to the support 20 in a position adjacent to the sliding plate 5, and the sliding seat 10 for the pawl 7 is obtained through the casing 13 on the side facing the plate 5; furthermore, the electrically actuated control means 8 for the pawl 7 are entirely accommodated into the casing 13, so that the device 6 made according to the invention may be used to replace a similar safety device according to the known art, without any change to the rest of the device 1.

According to a first aspect of the invention, the control means 8 comprise an electromagnet 30 having a winding 31 and a core 32 mobile along a symmetry axis B of the winding 31 and the core 32 is operatively associated to a slide 33 which is mobile parallelly to the axis B of the winding 31 between a first and a second limit stop position (shown in FIGS. 5 and 6, respectively), only in the first of which a side protrusion 35 of the slide 33 cooperates with the pawl 7, in particular it is arranged against a side appendix 7*b* thereof, on the opposite side with respect to the seat 10, to block the pawl 7 in the extracted position from the seat 10 itself.

The control means 8 further comprise, according to the invention, a retaining device 38 of the push-push type operatively associated on one side to the slide 33 and on the opposite side to a pre-loaded spring 39 sandwiched between the retaining device 38 and a contrast shoulder 40, fixed in use to the support 20, being integrally obtained in one piece with the casing 13, within the same; according to the main aspect of the invention, the push-push retaining device 38 is configured so as to be adapted to block the slide 33 in the first limit stop position (i.e. in the position shown in FIG. 5), following a single energising pulse provided by the electromagnet 30 and to release the slide 33, so as to allow the spring 39 to take it to the second limit stop position (i.e. to the position shown in FIG. 6), following two consecutive energising pulses of the electromagnet 30.

Preferably, the electrically actuated control means 8 also comprise actuating means 42 which are different from the electromagnet 30 and per se known, in particular adapted to displace the pawl 7 between the first and the second position, in the first position, extracted from the seat 10, the pawl 7 thoroughly engaging the perforation 11 of the plate 5, perpendicularly to a laying plane of the plate 5 itself.

Figure 9:
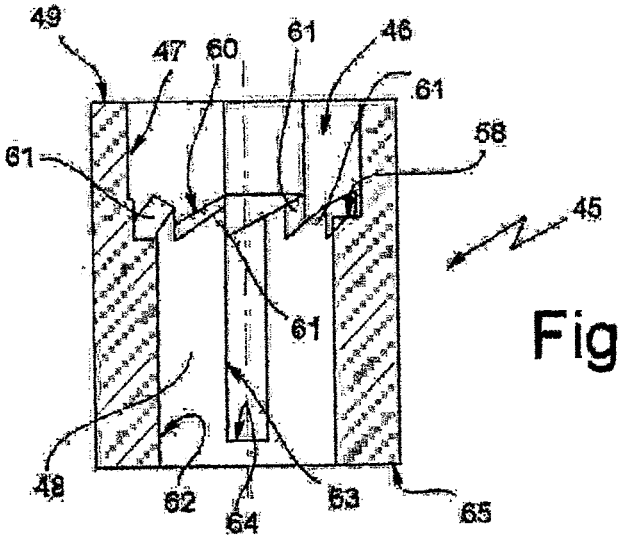

The push-push retaining device 38 comprises an accommodating bushing 45 (FIG. 9) integrally secured in use to the support 20, being integrally carried by the casing 13, inside the same, displaying a through seat 46 defined by a first 47 and a second 48 hole, having a different diameter and an axis parallel to that B of the winding 31, obtained reciprocally coaxial and in sequence through the bushing 45 from a first side 49 of the same (FIG. 3) facing the winding 31 in use.

Figure 7:
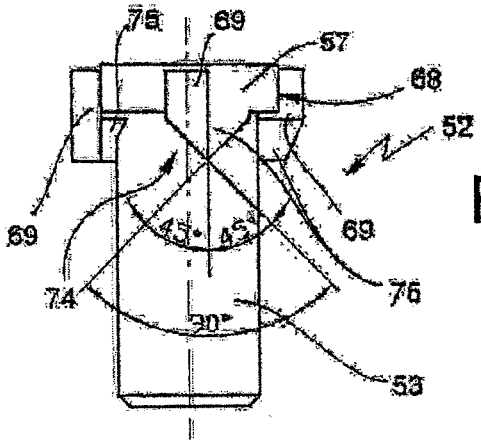
FIGS. 7, 8 and 9 show corresponding elevated views on an enlarged scale of three internal members of the safety device made according to the invention.
Figure 8:
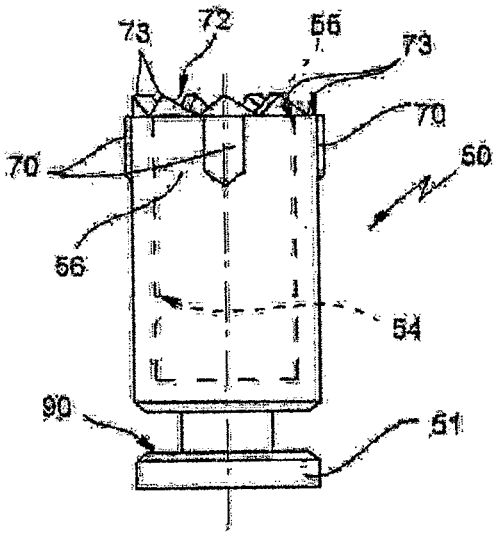

The device 38 further comprises a slidingly mounted pin 50 (FIG. 8) engaged into the hole 48 of the bushing 45 so that a first end 51 of the pin 50 overhangingly protrudes, in use, from the bushing 45, on the side opposite to the hole 47; the device 38 finally comprises a rotor 52 (FIG. 7) having a first cylindrical end 53 which is at least in part idly and slidingly engaged, in use, within a hole 54 of the pin 50, a blank hole 54 in the example shown, which hole 54 is coaxial to the holes 47, 48 and consequently with the axis B, and displays an access mouth 55 obtained at a second end 56 of the pin 50, opposite to the first (FIG. 8).

A second end 57 of the rotor 52 (FIG. 7), opposite to the first, is shaped so as to be adapted to selectively engage, in use, the holes 47 and 48 of the bushing, axially and abuttingly against the same. In particularly, the first hole 47 of the bushing 45 displays a larger diameter than that of the hole 48, so as to define between the holes 47,48 an annular axial shoulder zone 58 within the through seat 46; such an annular axial shoulder zone 58 is further provided with a front toothing 60, preferably having saw-shaped teeth 61, facing the winding 31 in use, in the circumferential direction according to the invention.

The bushing 45 is further provided, essentially at an internal side wall 62 of the hole 48, with a plurality of axial grooves 63 which extend, from the side facing the hole 47, to interrupt the continuity in the annular axial shoulder zone 58 and which end, on the opposite side, with corresponding blank ends 64 so as to define, within the bushing, corresponding axial stop shoulders arranged near the outlet of the second hole 48 on a second side 65 of the bushing 45, opposite to the first side 49 and thus facing the opposing side of the winding 31. The grooves 63 display a circumferential extension essentially of the same order of the circumferential extension of the teeth 61, and are arranged to interrupt the continuity, as we will see in greater detail, of selected teeth 61, according to a predetermined sequence.

The end 57 of the rotor 52 is laterally provided with a cylindrical guiding surface 68, adapted to slidingly couple in use with the internal side wall 62 of the hole 48, and with a plurality of first radial protrusions 69, equal in number to the number of axial grooves 63 of the bushing 45 and shaped so as to be accommodated within the hole 47 and adapted to slidingly engage in use the axial grooves 63.

The pin 50 is laterally provided on the outside, near the end 56 thereof, with a plurality of second radial protrusions 70 equal in number to the number of the axial grooves 63 of the bushing 45 and which are slidingly engaged, in use, in the axial groves 63 to abut, at a first limit stop position which may be taken by the pin 50 in relation to the bushing 45 (FIG. 6), against the axial stop shoulders 65 of the bushing 45 defined by the blank ends of the grooves 63.

Furthermore, the end 56 of the pin 50 is further provided with a front toothing 72, preferably with scalene triangle-profiled teeth 73 (or asymmetric saw-tooth shaped), facing the rotor 52 in use; on the contrary, the end 57 of the rotor 52 is provided, towards the first end 53 of the rotor 52 itself, with a frontal toothing 74, preferably with isosceles triangle-profiled teeth 75 (i.e. symmetric on opposite sides); the toothings 74, 72 and 60 reciprocally mate in the profile of the teeth, therefore the toothing 74 is adapted to mesh in use both with the front toothing 72 and with the front toothing 60, selectively or simultaneously, according to the relative position of the pin 50 with respect to the bushing 45.

Figure 4:
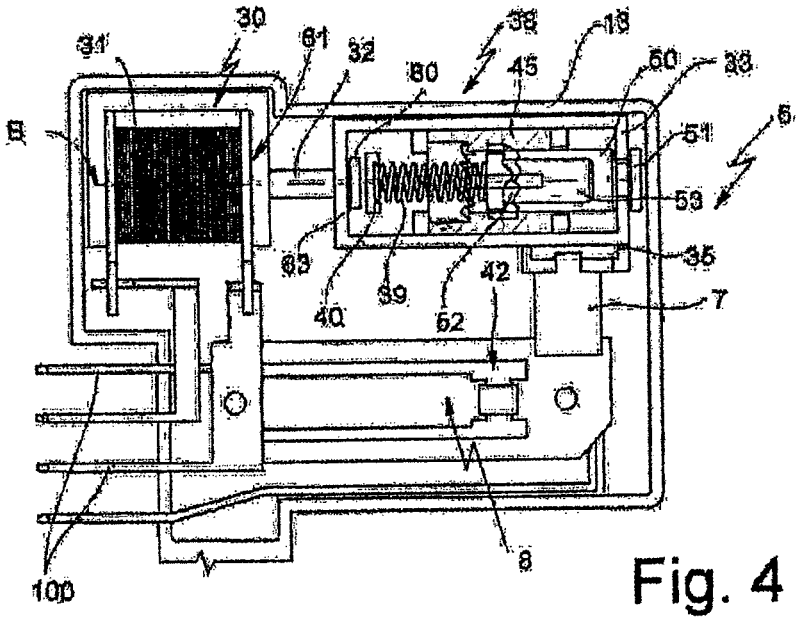
FIGS. 4, 5 and 6 show the same diagrammatic view as FIG. 2, with the safety device illustrated with the internal members thereof arranged according to three different operating positions.
Figure 2:
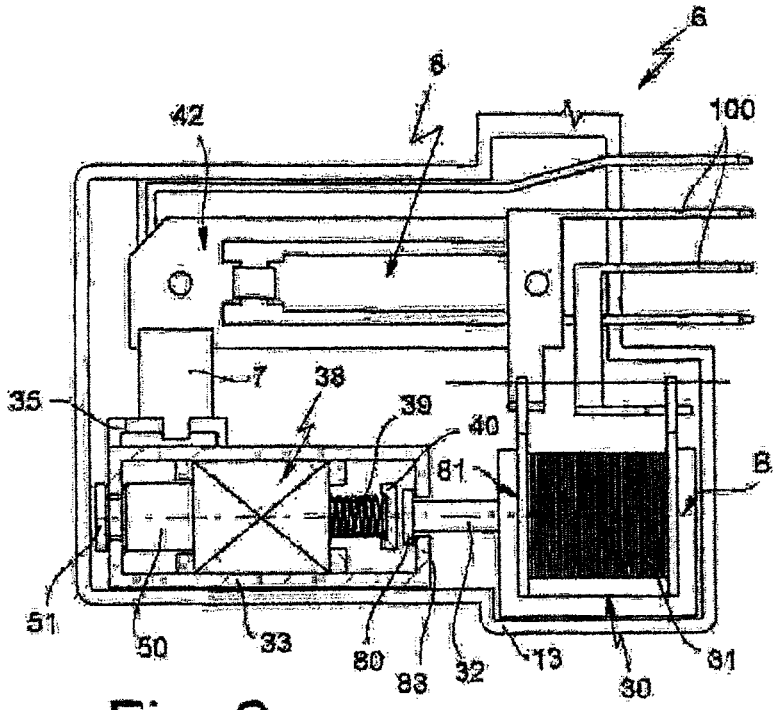
FIGS. 2 and 3 respectively show a diagrammatic plan view from the top and on enlarged scale of the internal structure of a safety device belonging to the device in FIG. 1 and of a detail thereof, shown on a further magnified scale.
Figure 3:
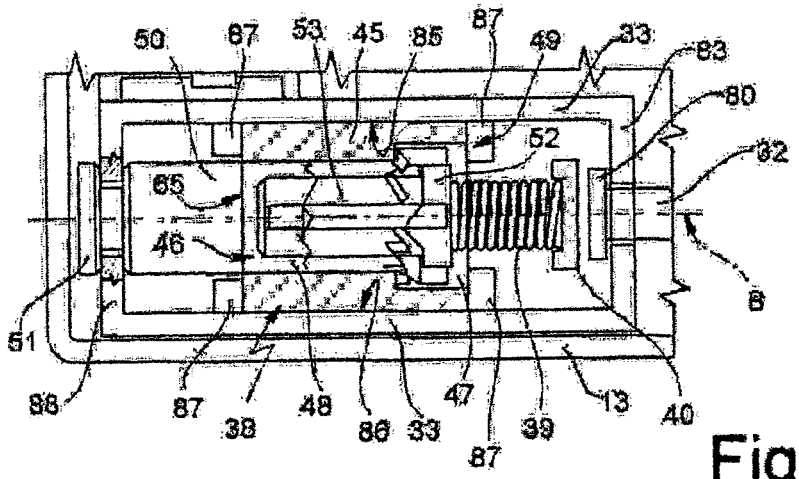
Figure 5:
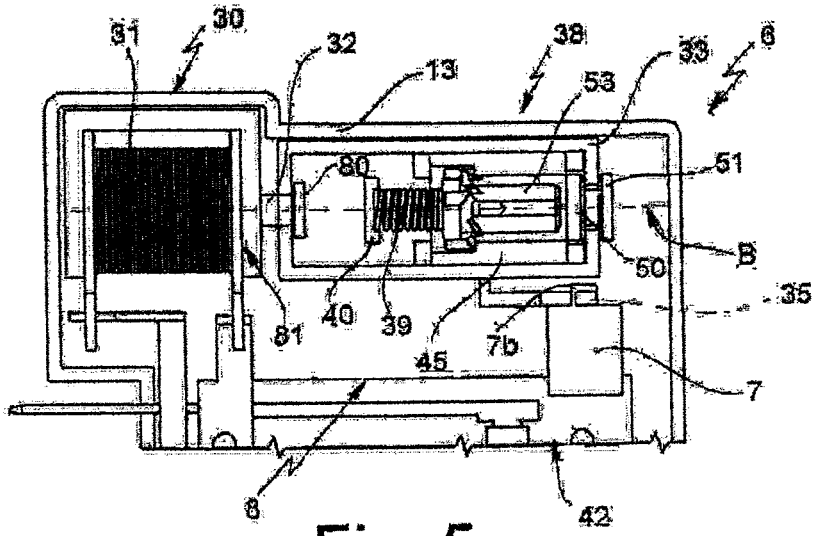
Figure 6:
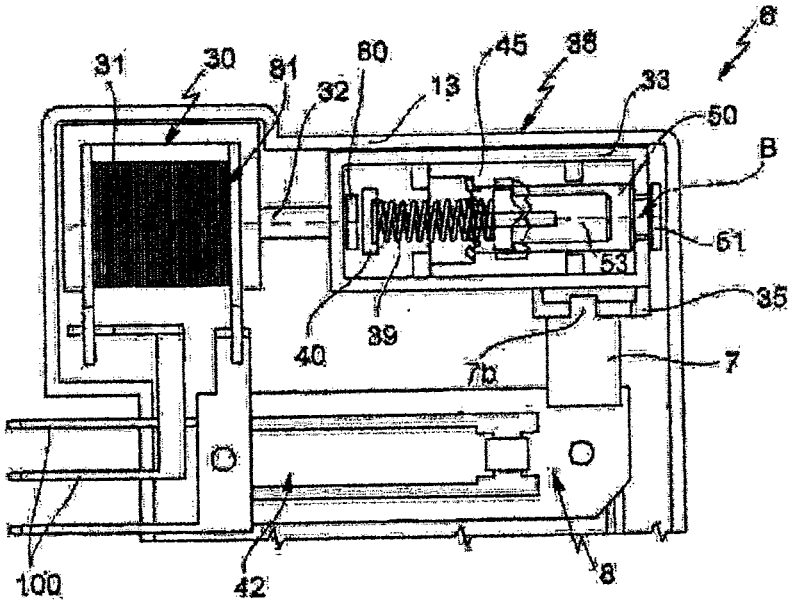

In particular, when the front toothing 74, selectively meshes either with the toothing 72 (FIG. 6) or with the toothing 60 (FIG. 4), it is adapted, as we will see in greater detail, to axially block the rotor 52, against the bias of the spring 39, selectively against the annular axial shoulder zone 58 and against the axial stop shoulders 64 of the bushing 45, respectively; while, when the frontal toothing 74 meshes at the same time with the toothings 60 and 72 (FIG. 5), it is adapted to produce the relative rotation of the rotor 52 with respect to the pin 50 and to the bushing 45, when the protrusions 69 of the rotor 52 do not engage the axial grooves 62 of the bushing 45 at a second limit position which may be taken by the pin 50 relatively to the bushing 45 (FIG. 5).

According to the invention, the number of teeth 75 of the frontal toothing 74 is chosen equal to the number of the protrusions 69; and, in combination, the number of teeth 61 of the frontal toothing 60 and the number of axial grooves 63 are chosen so that for every three consecutive teeth 61, the third tooth 61 is interrupted, for almost its entire circumferential extension, by a corresponding groove 63.

According to the illustrated embodiment, the core 32 axially and overhangingly protrudes, with a first end 80 thereof, from a first corresponding end 81 of the winding 31 facing in use the slide 33, to thoroughly engage a first end 83 of the slide 33, with which it axially cooperates abuttingly on the opposite side of that facing the winding 31.

Furthermore, the core 32 and the winding 31 are shaped so that, when the electromagnet 30 receives an electric energising pulse, the core 32 is attracted inside the winding 31, so as to feed, against the bias of the spring 39, the end 83 of the slide 33 towards the first end 81 of the winding 31.

The slide 33 is shaped in plan as a frame, which engages with its opposite internal sides 85,86 corresponding guiding elements 87 (FIG. 3) fixed in use to the support 20, being integrally secured in one piece with the casing 13 within the same, as the shoulder 40.

The push-push retaining device 38 and the spring 39, as well as the contrast shoulder 40, are arranged in a space delimited within the frame defining the slide 33 and being integrally secured to the guiding elements 87; in particular, the accommodation bushing 45 is driven between the guiding elements 87, so that the pin 50 is mobile parallelly to the axis B and so that the end 51 of the same thoroughly engages a second end 88 of the slide 33, e.g. by means of a slot 90 (FIG. 8), so as to be axially integral thereto, both towards the winding 31 and on the opposite side of the same.

The spring 39 is specifically sandwiched between the contrast shoulder 40 and the end 57 of the rotor 52, so as to push in use the latter towards the pin 50 and the bushing 45. The electric supply of the electromagnet 30 and the actuating means 42 is performed in a per se known manner by means of contacts 100 of the blade type (e.g. Faston).

In use, the starting position of the described device is shown in FIG. 4. The spring 39 pushes the rotor 52 against the pin 50, which is in the limit stop position against the shoulders 64 and inside the hole 48, because the protrusions 68 are aligned with the grooves 63. Therefore, the pin 50 forces the slide 33 into the limit stop position which is the farthest from the winding 31 and keeps the core 32 extracted from the same.

When by means of the contacts 100 a first electric energising pulse is supplied to the electromagnet 30, the winding 31 recalls the core 32, against the bias of the spring 39; consequently, the pin 50 and the rotor 52 slide into the hole 48 until the end 57 of the rotor 52 reaches the hole 47, thus disengaging the protrusions 68 from the grooves 63. In such a position, the grooves 63 are thus still engaged by the projections 70; accordingly, the final stroke of the pin 50 towards the winding 31 causes a rotation of the rotor 52 due to the meshing between the toothings 72 and 74, with the consequent misalignment of the projections 68 with respect to the grooves 63; when the electric energising pulse of the electromagnet 30 ceases, the spring 39 tends to produce again the extraction of the core 32 from the winding 31 but at this point the teeth 74 mesh with the teeth 61 and consequently block the sliding of the rotor 52; the slide 33 and the whole device 38 thus take the position shown in FIG. 5, in which the protrusion 35 is under the appendix 7*b*, thus blocking the pawl 7 in the desired manner (in the extracted position).

Upon the application of a second energising pulse of the electromagnet 30, the core 32 is attracted into the winding 31, thus slightly moving the slide 33 with a consequent movement of the pin 50 which is axially integral therewith, towards the electromagnet 30 and against the spring 39; this time, such a movement simply produces a further rotation of a tooth 61 of the rotor 52 with respect to the bushing 45, but the teeth 75 are kept engaged with the intact teeth 61 (free from grooves 63) and therefore the pawl 7 remains blocked.

Upon the application of a third pulse (therefore after two consecutive pulses), exactly the same sequence of movements is obtained, but this time the teeth 75 are taken to the teeth 61 which are incomplete because they are interrupted by the grooves 63, and the protrusions 68 are aligned again with the latter. Therefore, the spring 39 may expand, the bias thereof no longer contrasted by the shoulder zone 58, thus pushing the rotor 52 into the hole 48 and consequently the pin 50 and the slide 33 at the limit stop away from the winding 31; the starting position is thus restored (FIG. 6), with the consequent release of the pawl 7.

The invention claimed is:

1. A blocking device for a door of an electric household appliance having a door or viewing panel, comprising:

a plate sliding on a support securable to a side of said door and configured to be engaged by a striker of the door;

a safety device comprising a pawl and electrically actuated control means for selectively moving the pawl between a first and a second position, wherein the pawl respectively engages or does not engage the plate to block or not block the plate engaged with the striker;

wherein the control means comprises an electromagnet having a winding and a core which is mobile along an axis of the winding;

wherein the core is operatively associated to a slide which is moveable parallel to the axis of the winding between a first and a second limit stop position, only in the first limit stop position, a protrusion of the slide cooperates with the pawl to block the pawl in the first position; the control means further comprising a push-push retaining device operatively associated on one side to the slide and on the opposite side to a pre-loaded spring sandwiched between the retaining device and a contrast shoulder fixed to the support;

wherein the push-push retaining device comprises an accommodating bushing integrally secured to the support and having a through seat defined by a first and a second hole having different diameters and a shared axis parallel to the axis of winding;

the push-push retaining device being configured so as to be adapted to block the slide in the first limit stop position following a single energizing pulse of the electromagnet and to release the slide, so as to allow the spring to take it to the second limit stop position, following two consecutive energizing pulses of the electromagnet.

2. A device according to claim 1, wherein said first position of the pawl is an extracted position, and in that said second position of the pawl is a retracted position, respectively from/in a sliding seat thereof, the safety device comprising a casing secured to the support in a position adjacent to the sliding plate, and through which a sliding seat for the pawl towards the sliding plate is obtained; and wherein said electrically actuated control means for the pawl is disposed in the casing.

3. A device according to claim 1, wherein said electrically actuated control means comprises an actuating means configured to displace the pawl between the first and the second positions, wherein in said first position said pawl engages a perforation of the plate perpendicularly to a laying plane of the plate itself.

4. A device according to claim 1, wherein said push-push retaining device further comprises a slidingly mounted pin engaged within said second hole of the bushing so that a first end of the pin overhangingly protrudes from said bushing from the side opposite to the first hole of the bushing, and a rotor having a first cylindrical end engaged at least in part idly and slidingly within a hole of the pin, said hole being coaxial with said first and second holes of the bushing and define an access mouth formed at a second end of the pin opposite the first end, and a second end of the rotor opposite to the first end being adapted to selectively engage the first and the second holes of the bushing axially and abuttingly against the bushing.

5. A device according to claim 4, wherein said first hole of the bushing comprises a larger diameter than a diameter of the second hole defining an annular axial shoulder zone within the through seat of the bushing between the first and the second hole; said annular axial shoulder zone being provided in a circumferential direction with a first front saw-tooth shaped toothing facing the winding;

said bushing further comprising a plurality of axial grooves at an internal side wall of the second hole, said plurality of axial grooves extend from the part opposite to the first hole to interrupt the continuity in said annular axial shoulder zone and which end, on the opposite side, with corresponding blank ends so as to define corresponding axial stop shoulders arranged near the outlet of the second hole on a second side of the bushing opposite to the first.

6. A device according to claim 5, wherein said second end of the rotor is laterally provided with a guiding surface adapted to slidingly couple with the internal side wall of the second hole of the bushing; and a plurality of first radial protrusions, equal in number to the number of said axial grooves in the bushing and shaped so as to be accommodated within the first hole and adapted to slidingly engage the axial grooves.

7. A device according to claim 6, wherein said pin is laterally provided on the outside near said second end with a plurality of second radial protrusions, equal in number to the number of said axial grooves of the bushing and which are slidingly engaged in said axial grooves to abut, at a first limit stop position which may be taken by the pin in relation to the bushing, against said axial stop shoulders of the bushing defined by the blank ends of the axial grooves.

8. A device according to claim 5, wherein said second end of the pin is provided with a second front toothing with scalene triangle-profiled teeth facing the rotor; said second end of the rotor being provided with and extending towards the first end of the rotor a third frontal toothing with isosceles triangle-profiled teeth adapted to mesh with both said first and second front toothing; said third front toothing being adapted, when it selectively meshes with the first and second front toothing, to axially lock the rotor against the bias of said spring, and selectively against said annular axial shoulder zone and against said axial stop shoulders of the bushing, respectively; and said third frontal toothing being adapted, when it meshes at the same time with the first and the second front toothing, to produce the relative rotation of the rotor with respect to the pin and to the bushing, when the first protrusions of the rotor do not engage the axial grooves of the bushing at a second limit stop position which may be taken by the pin in relation to the bushing.

9. A device according to claim 8, wherein the number of teeth of said third front toothing is chosen equal to the number of said first protrusions; and in that, in combination the number of teeth of said first front toothing and the number of said axial grooves are chosen so that for every three consecutive teeth of the first front toothing, the third tooth is interrupted by a corresponding groove.

10. A device according to claim 4, wherein said core axially and overhangingly protrudes from a corresponding first end of the winding facing said slide to engage a first end of the slide, wherein said core axially cooperates abuttingly on the opposite side of that facing said winding.

11. A device according to claim 10, wherein said core and said winding are shaped so that when said electromagnet receives an electric energizing pulse, the core is attracted inside the winding, so as to feed said first end of the slide towards the first end of the winding, against the bias of said spring.

12. A device according to claim 10, wherein said slide is shaped as a frame, which engages corresponding guiding elements fixed to the support by means of its opposite internal sides; said push-push retaining device and said spring, as well as said contrast shoulder, being arranged in a space delimited within the frame defining said slide and being integrally secured to said guiding elements.

13. A device according to claim 12, wherein said accommodating bushing is driven between said guiding elements, so that said pin of the push-push retaining device is moveable parallel to the axis of the winding; said first end of the pin engaging a second end of said slide so as to be axially integral with it both towards said winding and on the opposite side of the same; said spring being sandwiched between said contrast shoulder and said second end of the rotor.

* * * * *